US010417988B2

(12) United States Patent
Xu

(10) Patent No.: US 10,417,988 B2
(45) Date of Patent: Sep. 17, 2019

(54) GATE DRIVER ON ARRAY DRIVING CIRCUIT AND LIQUID CRYSTAL DISPLAY DEVICE HAVING THE SAME

(71) Applicant: Shenzhen China Star Optoelectronics Technology Co., Ltd., Shenzhen, Guangdong (CN)

(72) Inventor: Xiangyang Xu, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 86 days.

(21) Appl. No.: 15/577,320

(22) PCT Filed: Oct. 11, 2017

(86) PCT No.: PCT/CN2017/105717
§ 371 (c)(1),
(2) Date: Nov. 27, 2017

(87) PCT Pub. No.: WO2019/041454
PCT Pub. Date: Mar. 7, 2019

(65) Prior Publication Data

US 2019/0073981 A1 Mar. 7, 2019

(30) Foreign Application Priority Data

Sep. 1, 2017 (CN) ..... 2017 1 0780879

(51) Int. Cl.
*G09G 3/36* (2006.01)

(52) U.S. Cl.
CPC ..... *G09G 3/3696* (2013.01); *G09G 3/3677* (2013.01); *G09G 3/3688* (2013.01);
(Continued)

(58) Field of Classification Search
CPC ..... G09G 2320/0276; G09G 2330/025; G09G 2330/026; G09G 2330/027;
(Continued)

(56) References Cited

U.S. PATENT DOCUMENTS

2006/0001640 A1 1/2006 Lee
2007/0195026 A1* 8/2007 Hagood ..... G02B 26/02 345/85

(Continued)

FOREIGN PATENT DOCUMENTS

CN 101271661 A 9/2008
CN 101339305 A 1/2009

(Continued)

OTHER PUBLICATIONS

CN201710780879X—1st Office Action.

*Primary Examiner* — Tony O Davis
(74) *Attorney, Agent, or Firm* — Andrew C. Cheng

(57) ABSTRACT

Disclosed is a gate driver on array driving circuit, coupled to a liquid crystal display panel. A voltage stabilizing capacitor and a transistor switch are arranged at an output end of a power circuit of the gate driver on array driving circuit of the present invention. The voltage stabilizing capacitor stabilizes a voltage output of the power circuit when the liquid crystal display panel is in a normal display state. The transistor switch controls the voltage stabilizing capacitor to be disconnected with the power circuit when the liquid crystal display panel is in an on state or an off state. Apparently, the gate driver on array driving circuit can avoid the overcurrent protection function of the power circuit triggered by the excessive instantaneous current generated by the charging and discharging of the voltage stabilizing capacitor at the instant when the liquid crystal display panel is turned on or off.

14 Claims, 3 Drawing Sheets

(52) U.S. Cl.
CPC ..... *G09G 2320/0276* (2013.01); *G09G 2330/025* (2013.01); *G09G 2330/026* (2013.01); *G09G 2330/027* (2013.01); *G09G 2330/04* (2013.01)

(58) Field of Classification Search
CPC ..... G09G 2330/04; G09G 3/3677; G09G 3/3688; G09G 3/3696
USPC ..... 345/157
See application file for complete search history.

(56) References Cited

U.S. PATENT DOCUMENTS

| | | | | |
|---|---|---|---|---|
| 2008/0088257 | A1 | 4/2008 | Zhou | |
| 2014/0035889 | A1* | 2/2014 | Huang | G09G 3/00 345/204 |
| 2015/0131771 | A1* | 5/2015 | Hu | G09G 3/20 377/68 |
| 2015/0381166 | A1* | 12/2015 | Kittila | H03K 17/0812 327/109 |
| 2018/0068628 | A1* | 3/2018 | Xiao | G09G 3/3648 |
| 2018/0174501 | A1* | 6/2018 | Cao | G05F 1/10 |
| 2018/0190221 | A1* | 7/2018 | Kuo | G09G 3/3648 |
| 2018/0234088 | A1* | 8/2018 | Narayanasamy | H03K 17/08122 |
| 2019/0066613 | A1* | 2/2019 | Chen | G09G 3/3655 |
| 2019/0108807 | A1* | 4/2019 | Li | G09G 3/3677 |

FOREIGN PATENT DOCUMENTS

| | | | |
|---|---|---|---|
| CN | 101369403 | A | 2/2009 |
| CN | 101409053 | A | 4/2009 |
| CN | 101562443 | A | 10/2009 |
| CN | 101739966 | A | 6/2010 |
| CN | 103166199 | A | 6/2013 |
| CN | 104575356 | A | 4/2015 |
| CN | 104935160 | A | 9/2015 |

* cited by examiner

GATE DRIVER ON ARRAY DRIVING CIRCUIT AND LIQUID CRYSTAL DISPLAY DEVICE HAVING THE SAME

CROSS REFERENCE

This application claims the priority of Chinese Patent Application No. 201710780879.X, entitled "Gate driver on array driving circuit and liquid crystal display device having the same", filed on Sep. 1, 2017, the disclosure of which is incorporated herein by reference in its entirety.

FIELD OF THE INVENTION

The present invention relates to a liquid crystal display field, and more particularly to a gate driver on array (GOA) driving circuit and a liquid crystal display device having the same.

BACKGROUND OF THE INVENTION

At present, the liquid crystal display panel is still the mainstream product of the flat panel display. In order to realize the narrow frame, the slimness and the low cost of the liquid crystal display panel, the development and application of the gate driver on array (GOA) driving circuit are relatively mature. A conventional GOA driving circuit of a liquid crystal display panel generally includes a power IC (integrated circuit), a timing controller, a gamma circuit and a source IC.

The insufficient discharging duration at the instant when the liquid crystal display panel is turned on or turned off will generate a larger instantaneous current. To avoid burnout of respective circuits in the GOA driving circuit when the current is too large, an overcurrent protection function is generally added in the power IC such that as the current of the power IC is larger than a predetermined threshold value, the power IC can be automatically turned off. In the GOA driving circuit according to prior art, a voltage stabilizing capacitor is generally configured at the output end of the power IC to stabilize the voltage output of the power IC. However, since the voltage stabilizing capacitor has charging and discharging function and generates a larger current as charging and discharging. Thus, the overcurrent protection function of the power circuit can be easily triggered at the instant when the liquid crystal display panel is turned on or off to cause a black screen phenomenon of the liquid crystal display panel. However, if the voltage stabilizing capacitor is not configured in the circuit, an irregularly displaying light spot (mura) and a color difference may be caused by noise jitters at the output end during normal display.

SUMMARY OF THE INVENTION

The embodiment of the present invention provides a gate driver on array driving circuit and a liquid crystal display device having the same, which can avoid the overcurrent protection function of the power circuit triggered by the excessive instantaneous current generated by the charging and discharging of the voltage stabilizing capacitor at the instant when the liquid crystal display panel is turned on or off to cause a black screen phenomenon of the liquid crystal display panel.

First, the embodiment of the present invention provides a gate driver on array driving circuit, comprising a power circuit, a sequence controller and a voltage stabilizing circuit, wherein the sequence controller and the voltage stabilizing circuit are electrically coupled to the power circuit, the voltage stabilizing circuit comprises a voltage stabilizing capacitor and a transistor switch, a first end of the transistor switch is coupled to the power circuit, a second end of the transistor switch is coupled to one end of the voltage stabilizing capacitor, the other end of the voltage stabilizing capacitor is grounded, a third end of the transistor switch receives a control signal generated by the sequence controller, the transistor switch controls a connection status between the voltage stabilizing capacitor and the power circuit under control of the control signal.

The gate driver on array driving circuit is coupled to a liquid crystal display panel, the sequence controller outputs the control signal of a low voltage level to the third end of the transistor switch to turn off the transistor switch and the voltage stabilizing capacitor and the power circuit are disconnected when the liquid crystal display panel is in an on state.

The sequence controller outputs the control signal of a high voltage level to the third end of the transistor switch to turn on the transistor switch and the voltage stabilizing capacitor is coupled to the power circuit via the transistor switch when the liquid crystal display panel is in a normal display state.

The sequence controller outputs the control signal of a low voltage level to the third end of the transistor switch to turn off the transistor switch and the voltage stabilizing capacitor and the power circuit are disconnected when the liquid crystal display device is in an off state.

The voltage stabilizing capacitor stabilizes a voltage output of the power circuit with a charging operation and/or a discharging operation when the voltage stabilizing capacitor is coupled to the power circuit via the transistor switch.

The transistor switch is a field effect transistor, the first end of the transistor switch is a drain of the transistor switch, the second end of the transistor switch is a source of the transistor switch and the third end of the transistor switch is a gate of the transistor switch.

The gate driver on array driving circuit further comprises a gamma circuit, a source driving circuit and a connector, wherein the gamma circuit, the source driving circuit and the connector are coupled to the power circuit, the power circuit provides the sequence controller, the voltage stabilizing circuit, the gamma circuit and the source driving circuit with a voltage required for operation, the gamma circuit is coupled to the source driving circuit, the gamma circuit provides the source driving circuit with a reference voltage required for implementing digital to analog conversion, the source driving circuit converts a digital gray scale signal into a liquid crystal voltage connected to two surfaces of a liquid crystal layer, the connector connects the power circuit and sequence controller.

The power circuit provides the gate driver on array driving circuit of the liquid crystal display panel with a voltage required for operation.

The sequence controller provides the source driving circuit and the gate driver on array driving circuit of the liquid crystal display panel with the control signal required for operation.

Second, the embodiment of the present invention further provides a liquid crystal display device, comprising the aforesaid gate driver on array driving circuit and a liquid crystal display panel coupled to the gate driver on array driving circuit.

In the embodiment of the present invention, the voltage stabilizing capacitor and the transistor switch are arranged at an output end of the power circuit of the gate driver on array driving circuit coupled to the liquid crystal display panel. The voltage stabilizing capacitor stabilizes a voltage output of the power circuit when the liquid crystal display panel is in a normal display state. The transistor switch controls the voltage stabilizing capacitor to be disconnected with the power circuit when the liquid crystal display panel is in an on state or an off state. Thus, the present invention can avoid the overcurrent protection (OCP) function of the power circuit triggered by the excessive instantaneous current generated by the charging and discharging of the voltage stabilizing capacitor at the instant when the liquid crystal display panel is turned on or off to cause a black screen phenomenon of the liquid crystal display panel.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

For better explaining the technical solution and the effect of the present invention, the present invention will be further described in detail with the accompanying drawings in the specific embodiments. It is clear that the described embodiments are part of embodiments of the present application, but not all embodiments. Based on the embodiments of the present invention, all other embodiments to those of ordinary skill in the premise of no creative efforts obtained, should be considered within the scope of protection of the present invention.

Besides, the following descriptions for the respective embodiments are specific embodiments capable of being implemented for illustrations of the present invention with referring to appended figures. For example, the terms of up, down, front, rear, left, right, interior, exterior, side, etcetera are merely directions of referring to appended figures. Therefore, the wordings of directions are employed for explaining and understanding the present invention but not limitations thereto.

In the description of the invention, which needs explanation is that the term "installation", "connected", "connection" should be broadly understood unless those are clearly defined and limited, otherwise, For example, those can be a fixed connection, a detachable connection, or an integral connection; those can be a mechanical connection, or an electrical connection; those can be a direct connection, or an indirect connection with an intermediary, which may be an internal connection of two elements. To those of ordinary skill in the art, the specific meaning of the above terminology in the present invention can be understood in the specific circumstances.

Besides, in the description of the present invention, unless with being indicated otherwise, "plurality" means two or more. In the present specification, the term "process" encompasses an independent process, as well as a process that cannot be clearly distinguished from another process but yet achieves the expected effect of the process of interest. Moreover, in the present specification, any numerical range expressed herein using "to" refers to a range including the numerical values before and after "to" as the minimum and maximum values, respectively. In figures, the same reference numbers will be used to refer to the same or like parts.

The embodiment of the present invention provides a gate driver on array (GOA) driving circuit and a liquid crystal display device having the same, which can avoid the overcurrent protection (OCP) function of the power circuit triggered by the excessive instantaneous current generated by the charging and discharging of the voltage stabilizing capacitor at the instant when the liquid crystal display panel is turned on or off to cause a black screen phenomenon of the liquid crystal display panel. The detail descriptions are respectively introduced below.

Figure 1:
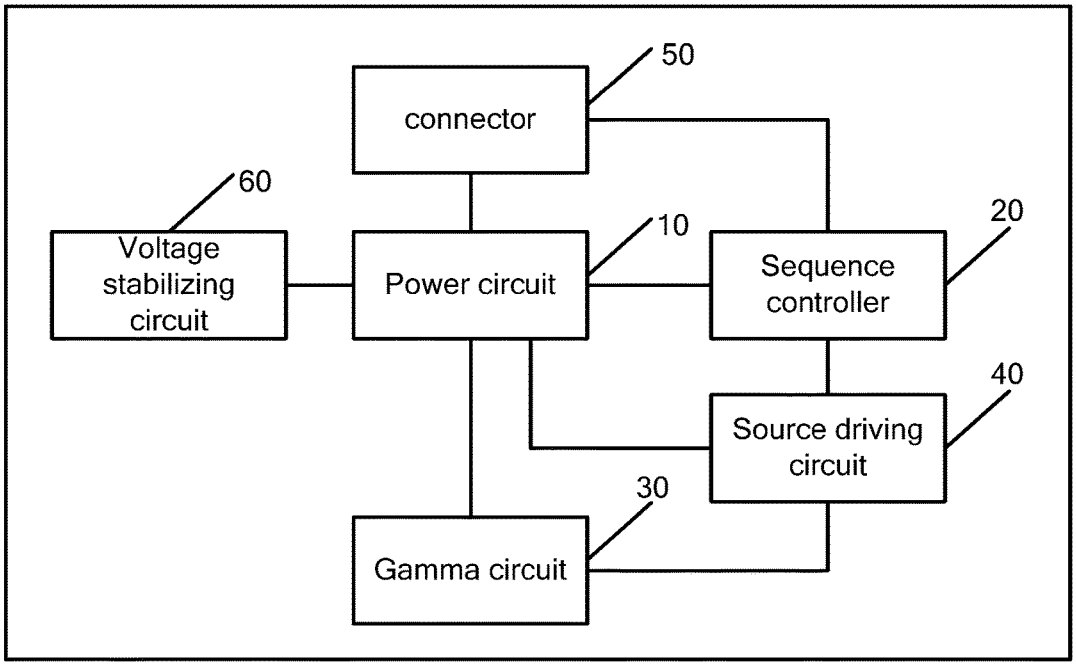
FIG. 1. is a circuit diagram of a gate driver on array driving circuit provided by the embodiment of the present invention.

Please refer to FIG. 1. FIG. 1. is a circuit diagram of a gate driver on array driving circuit provided by the embodiment of the present invention. As shown in FIG. 1, in the embodiment of the present invention, the gate driver on array (GOA) driving circuit at least comprises: a power circuit 10, a sequence controller 20, a gamma circuit 30, a source driving circuit 40, a connector 50 and a voltage stabilizing circuit 60.

All the sequence controller 20, the gamma circuit 30, the source driving circuit 40, the connector 50 and the voltage stabilizing circuit 60 are coupled to the power circuit 10. In the embodiment of the present invention, the gate driver on array driving circuit is coupled to a liquid crystal display panel. The power circuit 10 provides the respective circuits in the gate driver on array driving circuit and the gate driver on array driving circuit of the liquid crystal display panel with a voltage source required for operation. The gate driver on array driving circuit of the liquid crystal display panel comprises: a pull up controlling circuit, a pull up circuit, a pull down circuit, a first pull down maintaining circuit and a second pull down maintaining circuit. In the embodiment of the present invention, the power circuit 10 possesses over current protection function.

The sequence controller 20 is coupled to the source driving circuit 40 and the connector 50. The sequence controller 20 provides the source driving circuit 40 and the gate driver on array driving circuit of the liquid crystal display panel with the control signal required for operation. The connector 50 connects the sequence controller 20 and the power circuit 10. The gamma circuit 30 is coupled to the source driving circuit 40. The gamma circuit 30 provides the source driving circuit 40 with a reference voltage required for implementing digital to analog conversion. The source driving circuit 40 converts a digital gray scale signal into a liquid crystal voltage connected to two surfaces of a liquid crystal layer. The voltage stabilizing circuit 60 stabilizes a voltage output of the power circuit 10 to prevent the liquid crystal display panel from an irregularly displaying light spot (mura) and a color difference caused by noise jitters at the output end of the power circuit 10 during display.

Figure 2:
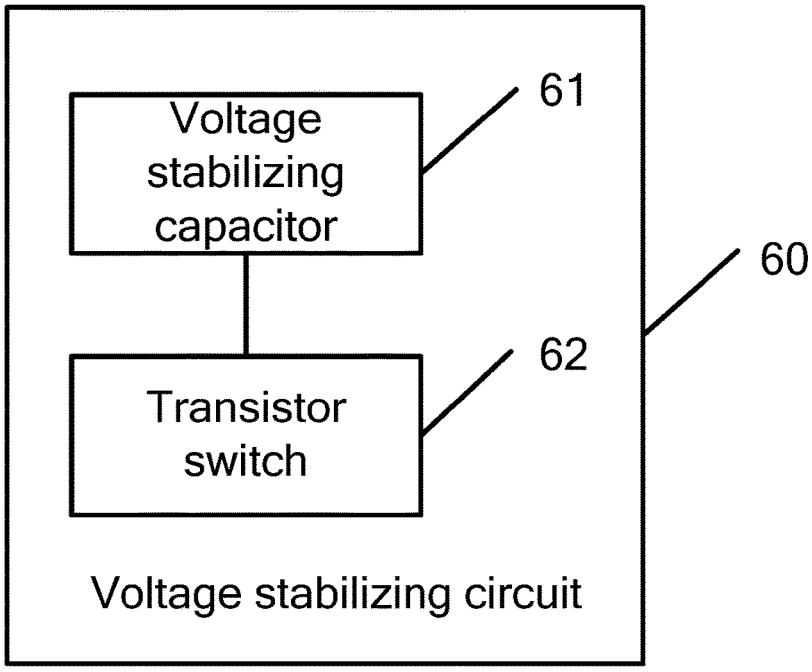
FIG. 2. is a circuit diagram of a voltage stabilizing circuit of a gate driver on array driving circuit provided by the embodiment of the present invention.

Please refer to FIG. 2. FIG. 2. is a circuit diagram of a voltage stabilizing circuit of a gate driver on array driving circuit provided by the embodiment of the present invention.

As shown in FIG. 2, in the embodiment of the present invention, the voltage stabilizing circuit 60 at least comprises a voltage stabilizing capacitor 61 and a transistor switch 62 coupled to the voltage stabilizing capacitor 61.

Figure 3:
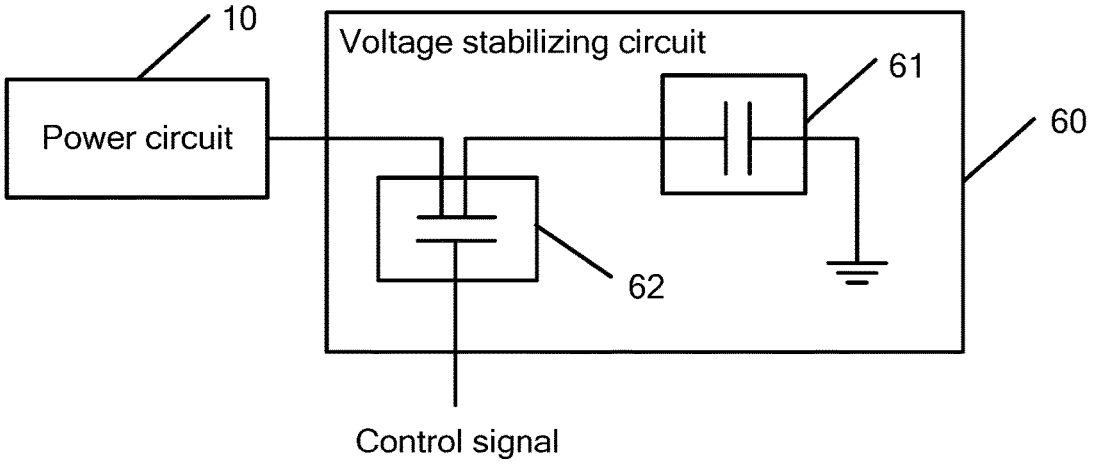
FIG. 3 is a connection diagram of a voltage stabilizing capacitor and a transistor switch in the voltage stabilizing circuit provided by the embodiment of the present invention.

Please also refer to FIG. 3. FIG. 3 is a connection diagram of a voltage stabilizing capacitor and a transistor switch in the voltage stabilizing circuit provided by the embodiment of the present invention. As shown in FIG. 3, a first end of the transistor switch 62 is coupled to the power circuit 10. A second end of the transistor switch 62 is coupled to one end of the voltage stabilizing capacitor 61. The other end of the voltage stabilizing capacitor 61 is grounded. A third end of the transistor switch 62 receives a control signal generated by the sequence controller and can be in different switch states (i.e. off state or on state) under control of the control signal. The transistor switch 62 controls a connection status between the voltage stabilizing capacitor 61 and the power circuit 10 under control of the control signal. Specifically, in the embodiment of the present invention, the transistor switch 62 is a field effect transistor (FET). The drain (the first end) of the transistor switch 62 is coupled to the power circuit 10. The source (the second end) of the transistor switch 62 is coupled to one end of the voltage stabilizing capacitor 61. The other end of the voltage stabilizing capacitor 61 is grounded. The gate (the third end) of the transistor switch 62 receives a control signal. The control signal controls the transistor switch 62 to be in different switch states.

Figure 4:
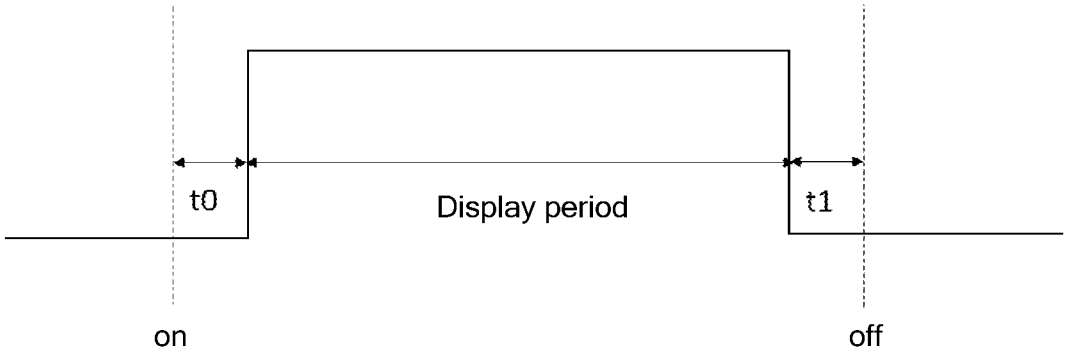
FIG. 4 is a sequence diagram of a control signal provided by the embodiment of the present invention.

In the embodiment of the present invention, the control signal of controlling the transistor switch 62 to be in different switch states can be generated by the sequence controller 20. The sequence controller 20 can generate a corresponding control signal according to the state of the liquid crystal display panel. The state of the liquid crystal display panel can be defined to comprise: an on state, a normal display state and an off state. Please refer to FIG. 4. FIG. 4 is a sequence diagram of a control signal provided by the embodiment of the present invention. As shown in FIG. 4, That the control signal controls the transistor switch 62 to be in different switch states can be: during the period from the liquid crystal display panel is turned on to the time t0 after the liquid crystal display panel is turned on, the liquid crystal display panel is in the on state, and the sequence controller 20 generates the control signal of low voltage level, which is insufficient to connect the source and the drain of the transistor switch 62. Then, the transistor switch 62 is in the off state. During the period (i.e. the display period) from the time t0 after the liquid crystal display panel is turned on to the time t1 before the liquid crystal display panel is turned off, the liquid crystal display panel is in the normal display state, and the sequence controller 20 generates the control signal of high voltage level to connect the source and the drain of the transistor switch 62. Thus, the transistor switch 62 is in the on state and the voltage stabilizing capacitor 61 starts to work, such as charging operation and/or discharging operation. During the period from the time t1 before the liquid crystal display panel is turned off to the liquid crystal display panel is turned off, the liquid crystal display panel is in the off state, and the sequence controller 20 generates the control signal of low voltage level to disconnect the source and the drain of the transistor switch 62. Thus, the transistor switch 62 is in the off state. Then, the voltage stabilizing capacitor 61 is disconnected from the power circuit 10.

It is understandable that the aforesaid t0 and t1 can be preset according to the actually required time for the liquid crystal display panel to be turned on or off.

Furthermore, that the transistor switch 62 controls a connection status between the voltage stabilizing capacitor 61 and the power circuit 10 under control of the control signal can be: when the liquid crystal display panel is in the on state, the transistor switch 62 is controlled by the control signal of low voltage level to be in the off state. Thus, the voltage stabilizing capacitor 61 and the power circuit 10 are disconnected. Then, the voltage stabilizing capacitor 61 cannot conduct the charging operation to avoid the overcurrent protection (OCP) function of the power circuit 10 triggered by the excessive instantaneous current generated with the charging and discharging of the voltage stabilizing capacitor 61 at the instant when the liquid crystal display panel is turned on to cause a black screen phenomenon of the liquid crystal display panel. When the liquid crystal display panel is in the normal display state, the transistor switch 62 is controlled by the control signal of high voltage level to be in the on state. Then, the voltage stabilizing capacitor 61 can be coupled to the power circuit 10 via the transistor switch 62 to stable the voltage output of the power circuit 10 with the charging operation and/or the discharging operation. When the liquid crystal display panel is in the off state, the transistor switch 62 is controlled by the control signal of low voltage level to be in the off state. Thus, the voltage stabilizing capacitor 61 and the power circuit 10 are disconnected. Then, Then, the voltage stabilizing capacitor 61 cannot conduct the charging operation to avoid the overcurrent protection (OCP) function of the power circuit 10 triggered by the excessive instantaneous current generated with the charging and discharging of the voltage stabilizing capacitor 61 at the instant when the liquid crystal display panel is turned off to cause a black screen phenomenon of the liquid crystal display panel at the same time.

Correspondingly, the embodiment of the present invention further provides a liquid crystal display device, comprising the aforesaid gate driver on array driving circuit and a liquid crystal display panel coupled to the gate driver on array driving circuit shown in FIG. 1.

In the embodiment of the present invention, the voltage stabilizing capacitor and the transistor switch are arranged at an output end of the power circuit of the gate driver on array driving circuit coupled to the liquid crystal display panel. The voltage stabilizing capacitor stabilizes a voltage output of the power circuit when the liquid crystal display panel is in a normal display state. The transistor switch controls the voltage stabilizing capacitor to be disconnected with the power circuit when the liquid crystal display panel is in an on state or an off state. Thus, the present invention can avoid the overcurrent protection (OCP) function of the power circuit triggered by the excessive instantaneous current generated by the charging and discharging of the voltage stabilizing capacitor at the instant when the liquid crystal display panel is turned on or off to cause a black screen phenomenon of the liquid crystal display panel.

In the description of the present specification, the reference terms, "one embodiment", "some embodiments", "an illustrative embodiment", "an example", "a specific example", or "some examples" mean that such description combined with the specific features of the described embodiments or examples, structure, material, or characteristic is included in the utility model of at least one embodiment or example. In the present specification, the terms of the above schematic representation do not certainly refer to the same embodiment or example. Meanwhile, the particular features, structures, materials, or characteristics which are described may be combined in a suitable manner in any one or more embodiments or examples.

The detail description has been introduced above for the gate driver on array driving circuit and liquid crystal display device provided by the embodiment of the invention. Herein, a specific case is applied in this article for explain the principles and specific embodiments of the present invention have been set forth. The description of the aforesaid embodiments is only used to help understand the method of the present invention and the core idea thereof; meanwhile, for those of ordinary skill in the art, according to the idea of the present invention, there should be changes either in the specific embodiments and applications but in sum, the contents of the specification should not be limitation to the present invention.

What is claimed is:

1. A gate driver on array driving circuit, comprising a power circuit, a sequence controller and a voltage stabilizing circuit, wherein the sequence controller and the voltage stabilizing circuit are electrically coupled to the power circuit, the voltage stabilizing circuit comprises a voltage stabilizing capacitor and a transistor switch, a first end of the transistor switch is coupled to the power circuit, a second end of the transistor switch is coupled to one end of the voltage stabilizing capacitor, the other end of the voltage stabilizing capacitor is grounded, a third end of the transistor switch receives a control signal generated by the sequence controller, the transistor switch controls a connection status between the voltage stabilizing capacitor and the power circuit under control of the control signal;

wherein the gate driver on array driving circuit is coupled to a liquid crystal display panel, the sequence controller outputs the control signal of a low voltage level to the third end of the transistor switch to turn off the transistor switch and the voltage stabilizing capacitor and the power circuit are disconnected when the liquid crystal display panel is in an on state;

further comprising a gamma circuit, a source driving circuit and a connector, wherein the gamma circuit, the source driving circuit and the connector are coupled to the power circuit, the power circuit provides the sequence controller, the voltage stabilizing circuit, the gamma circuit and the source driving circuit with a voltage required for operation, the gamma circuit is coupled to the source driving circuit, the gamma circuit provides the source driving circuit with a reference voltage required for implementing digital to analog conversion, the source driving circuit converts a digital gray scale signal into a liquid crystal voltage connected to two surfaces of a liquid crystal layer, the connector connects the power circuit and sequence controller.

2. The gate driver on array driving circuit according to claim 1, wherein the sequence controller outputs the control signal of a high voltage level to the third end of the transistor switch to turn on the transistor switch and the voltage stabilizing capacitor is coupled to the power circuit via the transistor switch when the liquid crystal display panel is in a normal display state.

3. The gate driver on array driving circuit according to claim 2, wherein the sequence controller outputs the control signal of a low voltage level to the third end of the transistor switch to turn off the transistor switch and the voltage stabilizing capacitor and the power circuit are disconnected when the liquid crystal display device is in an off state.

4. The gate driver on array driving circuit according to claim 2, wherein the voltage stabilizing capacitor stabilizes a voltage output of the power circuit with a charging operation and/or a discharging operation when the voltage stabilizing capacitor is coupled to the power circuit via the transistor switch.

5. The gate driver on array driving circuit according to claim 1, wherein the transistor switch is a field effect transistor, the first end of the transistor switch is a drain of the transistor switch, the second end of the transistor switch is a source of the transistor switch and the third end of the transistor switch is a gate of the transistor switch.

6. The gate driver on array driving circuit according to claim 1, wherein the power circuit provides the gate driver on array driving circuit of the liquid crystal display panel with a voltage required for operation.

7. The gate driver on array driving circuit according to claim 1, wherein the sequence controller provides the source driving circuit and the gate driver on array driving circuit of the liquid crystal display panel with the control signal required for operation.

8. A liquid crystal display device, comprising a gate driver on array driving circuit, wherein the gate driver on array driving circuit comprises a power circuit, a sequence controller and a voltage stabilizing circuit, wherein the sequence controller and the voltage stabilizing circuit are electrically coupled to the power circuit, the voltage stabilizing circuit comprises a voltage stabilizing capacitor and a transistor switch, a first end of the transistor switch is coupled to the power circuit, a second end of the transistor switch is coupled to one end of the voltage stabilizing capacitor, the other end of the voltage stabilizing capacitor is grounded, a third end of the transistor switch receives a control signal generated by the sequence controller, the transistor switch controls a connection status between the voltage stabilizing capacitor and the power circuit under control of the control signal;

wherein the gate driver on array driving circuit is coupled to a liquid crystal display panel, the sequence controller outputs the control signal of a low voltage level to the third end of the transistor switch to turn off the transistor switch and the voltage stabilizing capacitor and the power circuit are disconnected when the liquid crystal display panel is in an on state;

further comprising a gamma circuit, a source driving circuit and a connector, wherein the gamma circuit, the source driving circuit and the connector are coupled to the power circuit, the power circuit provides the sequence controller, the voltage stabilizing circuit, the gamma circuit and the source driving circuit with a voltage required for operation, the gamma circuit is coupled to the source driving circuit, the gamma circuit provides the source driving circuit with a reference voltage required for implementing digital to analog conversion, the source driving circuit converts a digital gray scale signal into a liquid crystal voltage connected to two surfaces of a liquid crystal layer, the connector connects the power circuit and sequence controller.

9. The liquid crystal display device according to claim 8, wherein the sequence controller outputs the control signal of a high voltage level to the third end of the transistor switch to turn on the transistor switch and the voltage stabilizing capacitor is coupled to the power circuit via the transistor switch when the liquid crystal display panel is in a normal display state.

10. The liquid crystal display device according to claim 9, wherein the sequence controller outputs the control signal of a low voltage level to the third end of the transistor switch to turn off the transistor switch and the voltage stabilizing capacitor and the power circuit are disconnected when the liquid crystal display device is in an off state.

11. The liquid crystal display device according to claim 9, wherein the voltage stabilizing capacitor stabilizes a voltage output of the power circuit with a charging operation and/or a discharging operation when the voltage stabilizing capacitor is coupled to the power circuit via the transistor switch.

12. The liquid crystal display device according to claim 8, wherein the transistor switch is a field effect transistor, the first end of the transistor switch is a drain of the transistor switch, the second end of the transistor switch is a source of the transistor switch and the third end of the transistor switch is a gate of the transistor switch.

13. The liquid crystal display device according to claim 8, wherein the power circuit provides the gate driver on array driving circuit of the liquid crystal display panel with a voltage required for operation.

14. The liquid crystal display device according to claim 8, wherein the sequence controller provides the source driving circuit and the gate driver on array driving circuit of the liquid crystal display panel with the control signal required for operation.

* * * * *